US006478943B1

(12) United States Patent
Lasia et al.

(10) Patent No.: US 6,478,943 B1
(45) Date of Patent: Nov. 12, 2002

(54) METHOD OF MANUFACTURE OF ELECTROCHEMICALLY TEXTURED SURFACE HAVING CONTROLLED PEAK CHARACTERISTICS

(75) Inventors: Andrzej Lasia, Sherbrooke, P.Q. (CA); Zhaojiang Li, Sherbrooke (CA); Rod Barr, Welland (CA)

(73) Assignee: Roll Surface Technologies, Inc., Grimsby (CA)

( * ) Notice: Subject to any disclaimer, the term of this patent is extended or adjusted under 35 U.S.C. 154(b) by 6 days.

(21) Appl. No.: 09/585,012

(22) Filed: Jun. 1, 2000

(51) Int. Cl.[7] ..... C25D 5/18
(52) U.S. Cl. ..... 205/82; 205/104
(58) Field of Search ..... 205/50, 82, 83, 205/102, 104

(56) References Cited

U.S. PATENT DOCUMENTS

| | | | | |
|---|---|---|---|---|
| 4,038,158 A | | 7/1977 | Bursey | |
| 4,092,226 A | | 5/1978 | Laing | |
| 4,468,293 A | | 8/1984 | Polan | |
| 4,515,671 A | | 5/1985 | Polan | |
| 4,804,446 A | | 2/1989 | Lashmore | |
| 4,869,971 A | | 9/1989 | Nee | |
| 5,185,073 A | | 2/1993 | Bindra | |
| 5,415,761 A | | 5/1995 | Müll | |
| 5,800,930 A | * | 9/1998 | Chen et al. | 428/607 |
| 5,958,207 A | | 9/1999 | Müll | |

FOREIGN PATENT DOCUMENTS

| | | |
|---|---|---|
| DE | 26 04 628 | 8/1977 |
| DE | 199 53 318 A 1 | 6/2000 |
| WO | PCT/EP94/03314 | 4/1995 |

OTHER PUBLICATIONS

Tai–Ping Sun, et al.: "*Plating With Pulsed and Priodic–Reverse Current*". Metal Finishing, May 1979, pp. 33–38.
International Search Report for PCT/CA 01/00985 Date of Publication Not Available.

* cited by examiner

*Primary Examiner*—Nam Nguyen
*Assistant Examiner*—William T. Leader
(74) *Attorney, Agent, or Firm*—Norris, McLaughlin & Marcus

(57) ABSTRACT

Textured surfaces comprised of peaks which have been electrochemically deposited on a substrate are prepared using a pulsed direct current process. Typical substrates are machine components such as a machine roll. Improved textured surfaces are made according to the invention by controlling the density, uniformity and size of the peaks using a pulsed direct current process. Accordingly, the peak characteristics are predetermined by selecting a pulse wave form having specific current density and pulse interval parameters as well as a total deposition time which will deposit peaks having desired characteristics on the substrate.

7 Claims, 8 Drawing Sheets

METHOD OF MANUFACTURE OF ELECTROCHEMICALLY TEXTURED SURFACE HAVING CONTROLLED PEAK CHARACTERISTICS

BACKGROUND OF THE INVENTION

1. Field of the Invention

The invention has to do with machine components having textured surfaces with controlled surface morphology which are prepared by means of electrochemical deposition. More particularly, the textured surfaces are comprised of peaks which have been electrochemically deposited on a substrate wherein the density, uniformity and size of the peaks is controlled by varying current density and other parameters in a pulsed direct current process.

2. The Related Art

Electrochemical methods of preparing textured surfaces have been described in the art. U.S. Pat. No. 5,185,073 to Bindra, et al., for example, describes the use of pulse electroplating and other methods for making dendritic surfaces. According to Bindra, the current is interrupted at a low frequency pulse rate on the order of 50 to 450 per second during the deposition. For example, palladium dendrite pulse plating was done at a peak current density of 500-1000 mA/cm$^2$, a duty cycle of 10 to 20% and a pulse repetition rate of 200-417 per second. The reference, however, does not teach or suggest that peak characteristics can be controlled by a pulsed direct current process and it does not relate to dendritic surfaces of the type and composition which are deposited on machine components.

Pulse plating to make smooth surfaces is known, for example, a method to make nickel films is described in the May 1979 issue of *Metal Finishing* by Sun, et al., "*Plating With Pulsed and Periodic-Reverse Current*", pp. 33-38. The use of pulse plating to make hard smooth coatings of trivalent chromium is disclosed in U.S. Pat. No. 4,804,446 to Lashmore, et al. and U.S. Pat. No. 4,869,971 to Nee, et al. describes the use of pulse plating to make multi-layer smooth metallic surfaces. None of these pulse plating methodologies produce textured surfaces of the type made according to the present invention.

An electrochemical process for treating copper sheet or foil to produce an adherent nodularized surface, having a fine dendritic structure, which can be bonded to a non-metallic substrate is described in U.S. Pat. No. 4,468,293 and its divisional 4,515,671 to Polan, et al. According to Polan, the bath solution is maintained substantially at room temperature and pulses having a first current density from about 55 mA/cm$^2$ to about 350 mA/cm$^2$ followed by a second current density from about 5 mA/cm$^2$ to about 50 mA/cm$^2$ are employed. Polan's frequency is from about 1 Hz to about 10,000 Hz and total deposition time is from about 2 seconds to about 60 seconds.

Electrochemical methods of depositing a structured surface layer on machine components are described in U.S. Pat. Nos. 5,415,761 and 5,958,207 to Mull but these methods require the use of complex ramping and stepwise waveforms.

The present invention provides a new method using a pulsed direct current process to electrochemically deposit, on an electrically conductive substrate, a textured surface having predictable peak characteristics. Typically, the substrate is a machine component such as a machine roll.

Machine components that require textured surfaces have various applications and they require various peak characteristics. Even within the same type of application, the required peak characteristics can vary substantially depending upon product needs and customer specifications. The present invention addresses these needs by providing a new methodology which enables those skilled in the art to customize the peak characteristics of a textured surface.

All percentages set forth herein are by weight/weight unless specifically denoted otherwise.

SUMMARY OF THE INVENTION

The improved textured surfaces of the invention can be deposited on various machine components such as machine rolls. The machine components having a textured surface made according to the invention can be used without further processing or they can be subjected to additional mechanical, chemical or electrochemical processes.

According to the invention, the desired density, uniformity and size of the peaks required for a textured surface are identified based on application requirements or customer specifications. The electrochemical parameters then are selected to make a surface texture having the requisite specifications. The parameters identified by the inventors herein have been found to have predictable effects on surface properties so that processing conditions can be identified with a minimum amount of experimentation. After the processing conditions have been identified, a machine component is immersed in a suitable electrodeposition bath. A charge having a first current density ($i_t$) is passed through the bath to the machine component and maintained for a first time interval ($t_t$). The current density then is reduced to a second current density ($i_b$) and maintained for a second time interval ($t_b$). The current density then is increased to the first current density again and the cycle is repeated multiple times until the passage of a total deposition time ($tt_d$). The first current density is greater than the second current density and the second current density is greater than zero.

The density, uniformity and size of the peaks is controlled according to the invention by varying the values of the parameters $i_t$, $i_b$, $t_t$, $t_b$ and $tt_d$. The ratio of $t_t/t_b$ also has an effect on peak characteristics. We have found that varying the value of $i_t$ provides a coarse adjustment of peak characteristics and when the ratio of $t_t/t_b$ is greater than 1, preferably from about 2:1 to about 6.5:1, especially about 2:1, variations in the values of $t_t$ and $t_b$ can provide a fine adjustment of peak characteristics. The relationship of each parameter to the surface characteristics of the end product is described in more detail below.

The temperature of the electrodeposition bath is maintained within the traditional operating range of the electrodeposition chemistry being plated, as is well known to those skilled in the art. When the process of the invention is applied to plating chrome, it is conducted at a bath temperature greater than 46° C. and less than 60° C. and preferably from about 47° to about 55° C.; most preferably from about 47° to about 52° C.

DESCRIPTION OF THE PREFERRED EMBODIMENTS

The preferred embodiments are described in terms of the parameters used to plate nodular or dendritic chrome but this is not intended to limit the invention. Based upon the principles set forth herein, those skilled in the art will be able to apply the process of the invention to the nodular or dendritic plating of other metals.

The products of the invention have a random yet predictable and controlled surface morphology, resulting in the ability to engineer the desired surface texture characteristics required to optimize field performance.

Figure 1:
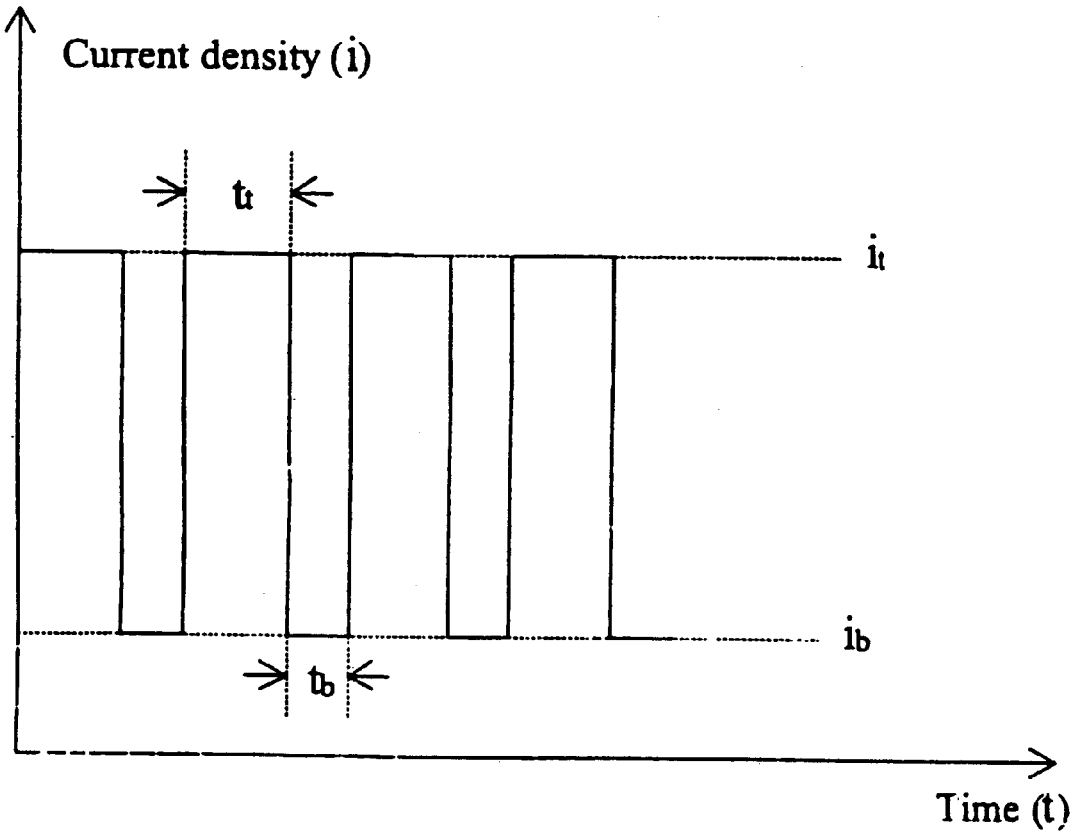
FIG. 1 is a typical pulse waveform employed in the process of the invention.
Figure 2:
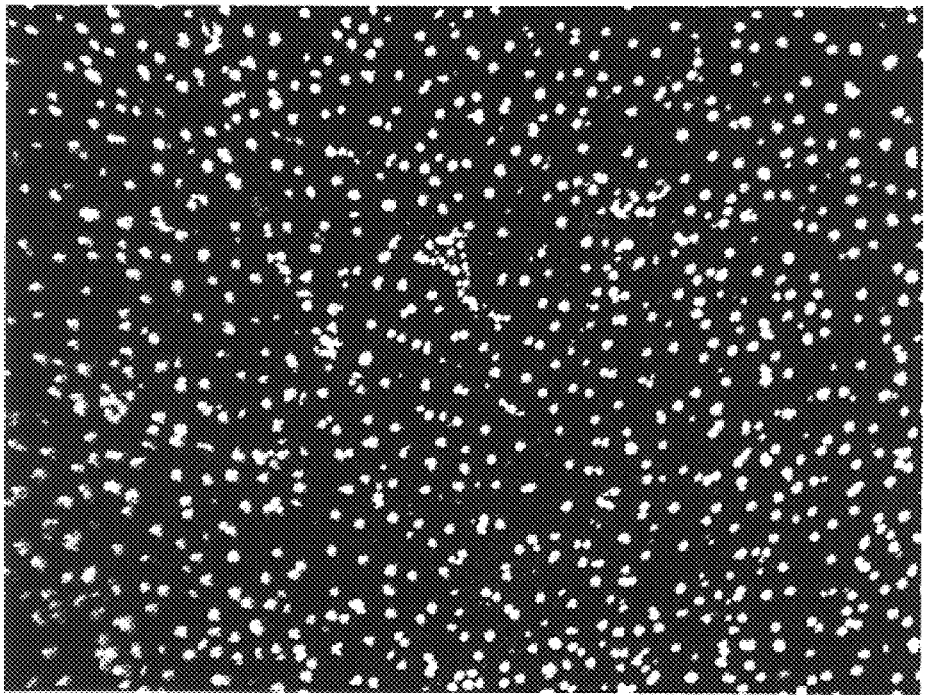
FIG. 2 is a photomicrograph taken at 100× magnification of Sample I made according to Example 4.
Figure 3:
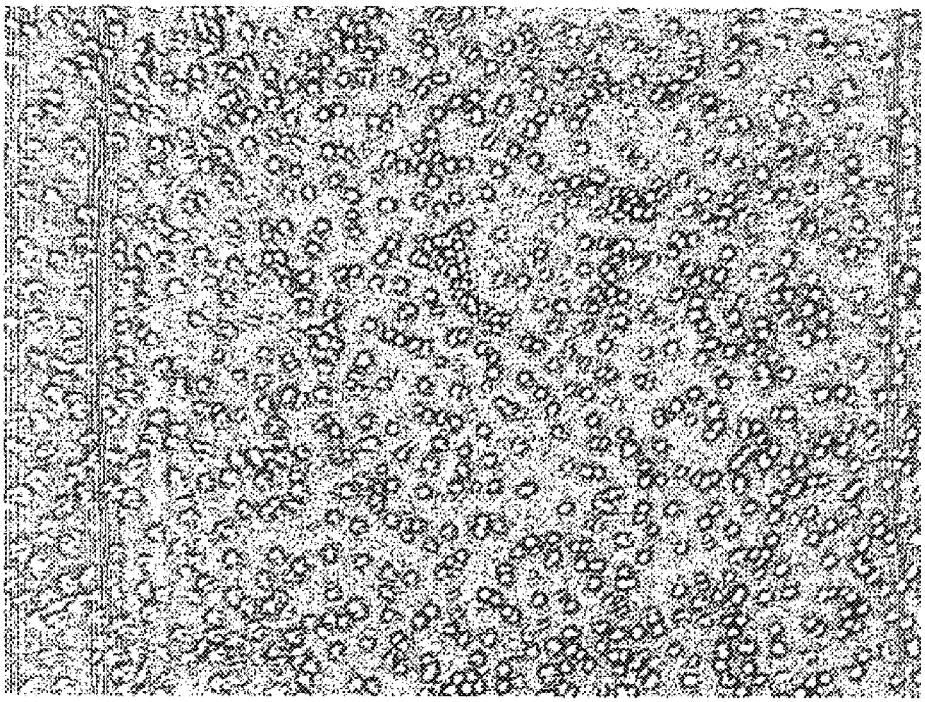
FIG. 3 is an enhanced version of the photomicrograph of FIG. 2.
Figure 4:
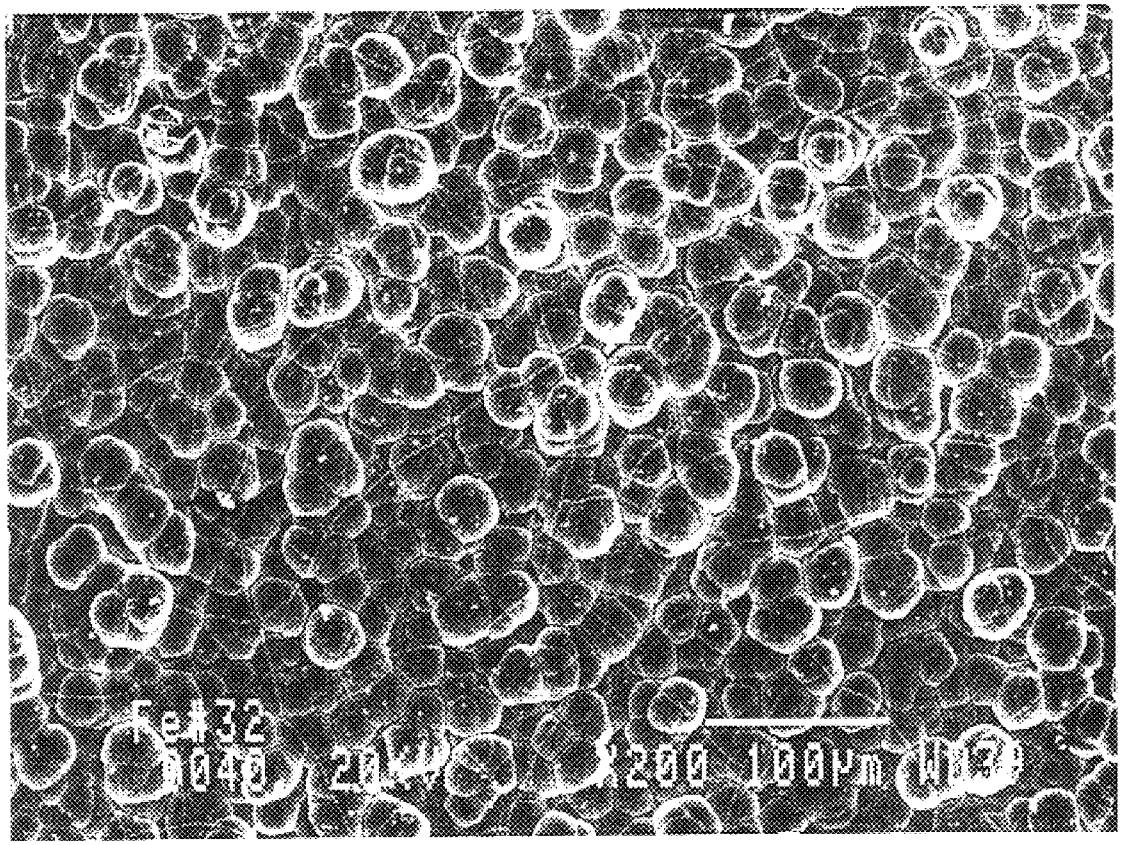
FIG. 4 is a SEM photograph of Sample I taken at 20 kilovolts and 200× magnification.
Figure 5:
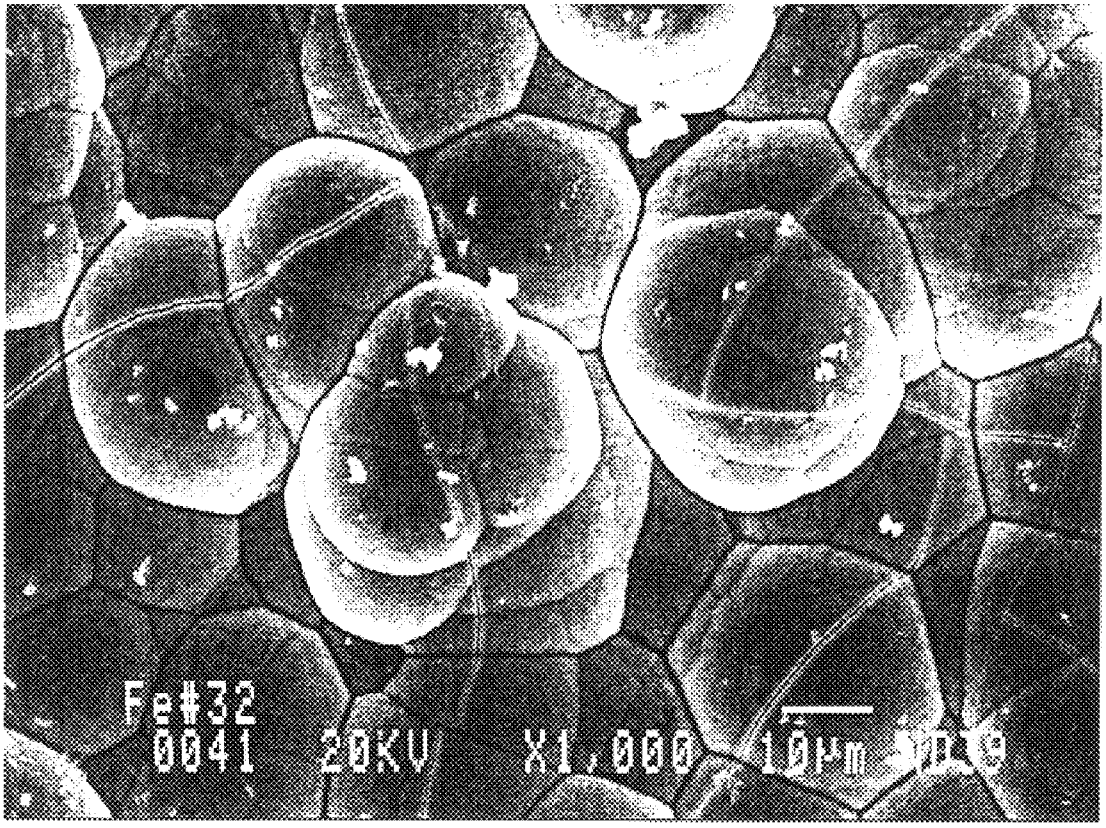
FIG. 5 is a SEM photograph of Sample I taken at 20 kilovolts and 1,000× magnification.
Figure 6:
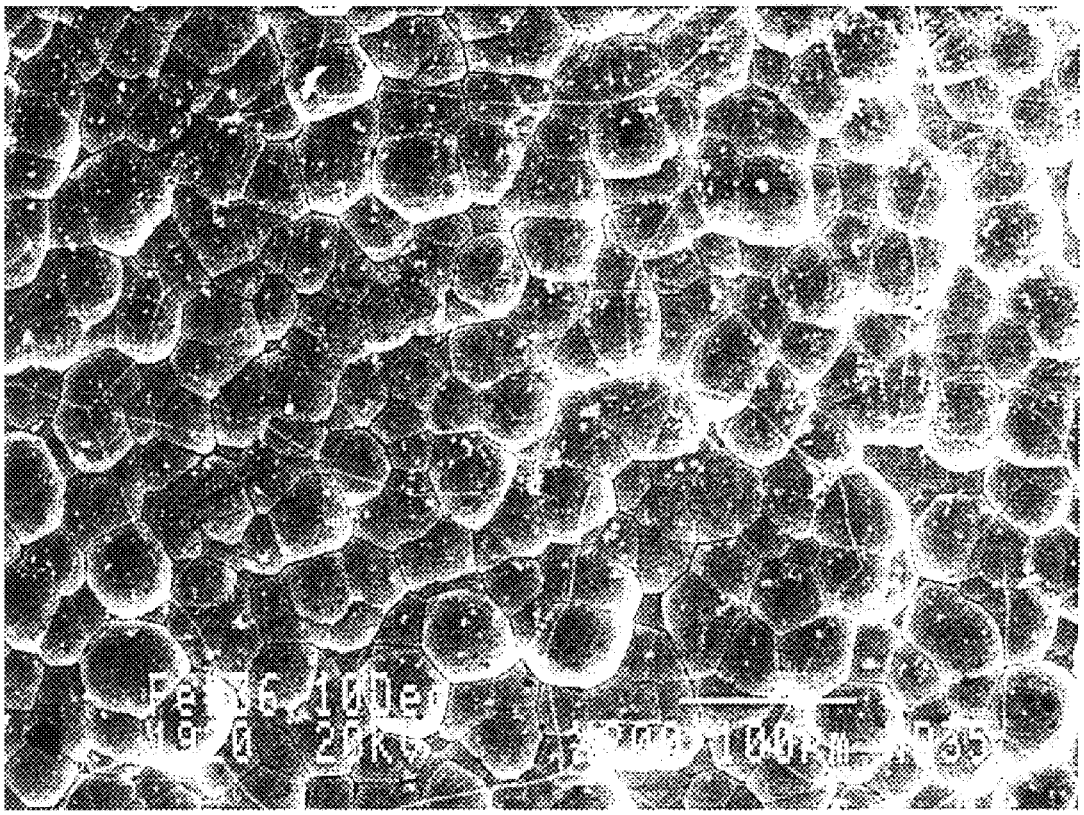
FIG. 6 is a SEM photograph of Sample J, made according to Example 4, taken at 20 kilovolts and 200× magnification.
Figure 7:
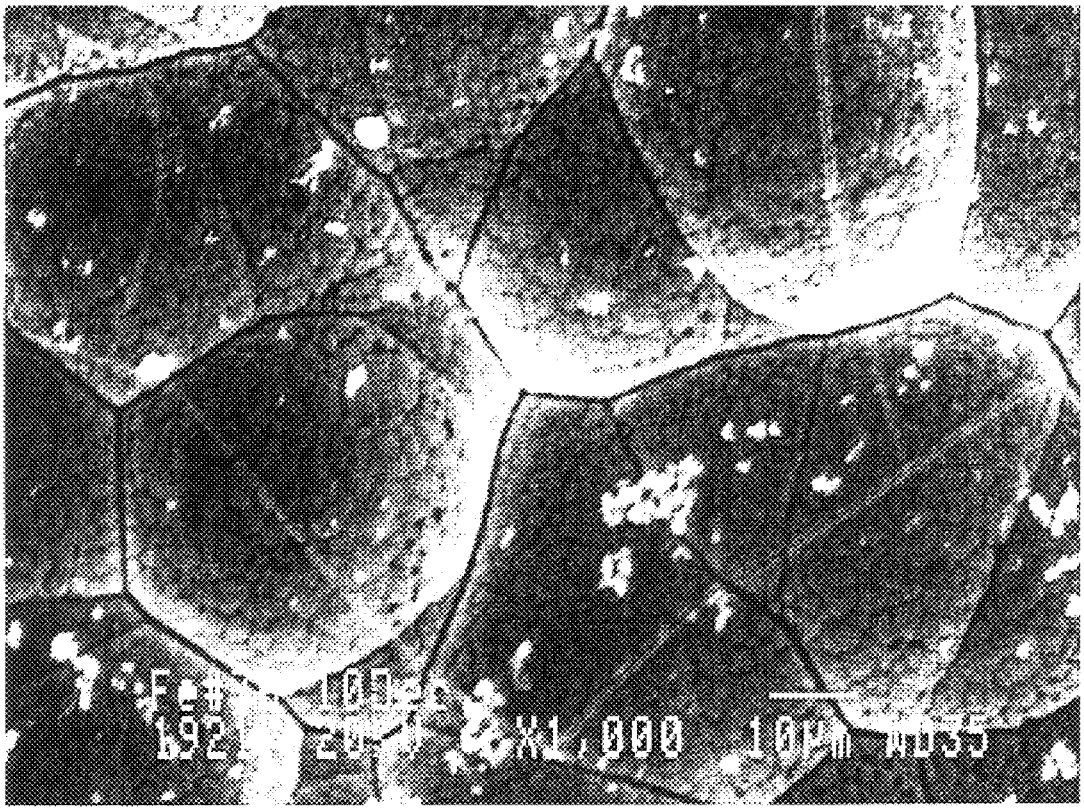
FIG. 7 is a SEM photograph of Sample J taken at 20 kilovolts and 1,000× magnification.
Figure 8:
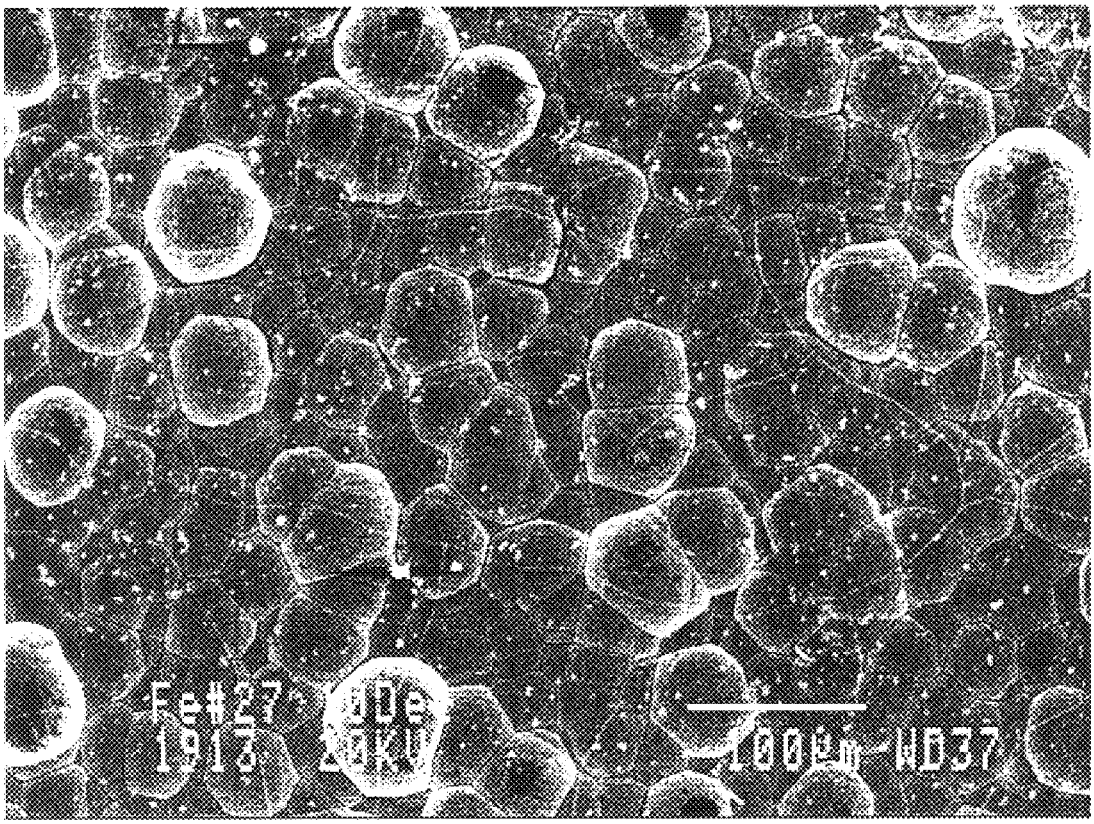
FIG. 8 is a SEM photograph of Sample K, made according to Example 4, taken at 20 kilovolts and 200× magnification.
Figure 9:
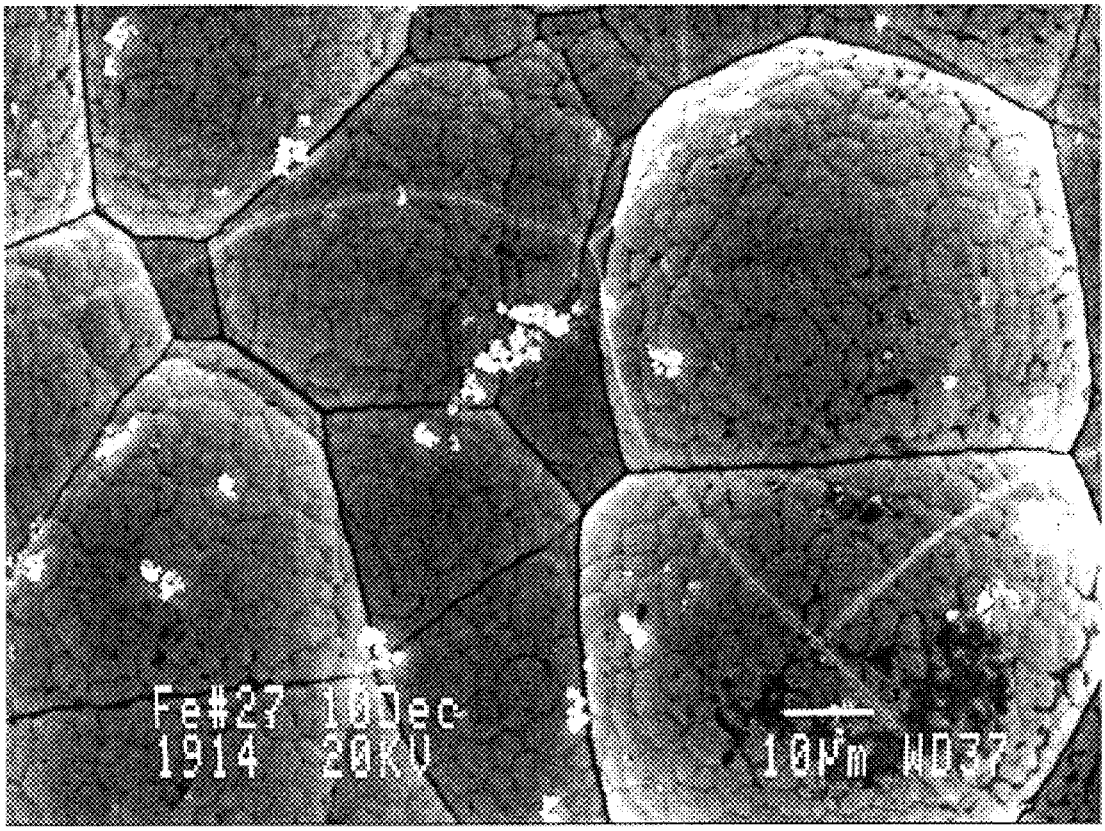
FIG. 9 is a SEM photograph of Sample K taken at 20 Kilovolts and 1,000× magnification.

Considering the drawings in detail, FIG. 1 illustrates a typical pulse waveform of the invention wherein current density is measured along the vertical axis and time is measured along the horizontal axis. The first current density is $i_t$, the first time interval is $t_t$, the second current density is $i_b$ and the second time interval is $t_b$. We have found that $i_b$ must be greater than zero because our experiments with $i_b$ at less than zero produced dark deposits which were not dendritic. Preferably, $i_b$ is greater than about 5 mA/cm$^2$ and most preferably greater than about 50 mA/cm$^2$. The first current density $i_t$ is greater than about 1,500, preferably greater than about 1,900 mA/cm$^2$. The maximum value for $i_t$ should be consistent with the object of the invention to provide a low current process and generally is not more than about 8,000 mA/cm$^2$, preferably not more than about 4,000 mA/cm$^2$. Excellent results are obtained when $i_t$ is from about 1,900 mA/cm$^2$ to about 3,000 mA/cm$^2$.

The time intervals $t_t$ and $t_b$ are used to "fine tune" the properties of the textured surface. Preferably $t_t$ is greater than $t_b$ and in a most preferred embodiment the ratio of $t_t$: $t_b$ is from about 2:1 to about 6.5 :1, with excellent results being obtained at a ratio of about 2:1. Generally $t_t$ is from about 40 to about 60,000 milliseconds (ms) (i.e., about 40 ms to about 60 seconds) and it is preferably from about 40 to about 200 ms. The time interval $t_b$ is generally from about 20 to about 30,000 ms (i.e., about 20 ms to about 30 seconds) and it is preferably from about 20 to about 100 ms. The total deposition time ($tt_d$) is generally greater than about 40 minutes and less than about 240 minutes, preferably less than about 120 minutes, depending upon the desired roughness.

The temperature of the electrodeposition bath for plating chrome must be greater than 46° C. and less than 60° C. in order to obtain a dendritic surface texture using our pulsed direct current process.

Surface texture characteristics can be measured by various known techniques and commercially available equipment is used. In addition, photomicrographs can be used for a visual assessment of surface characteristics. Roughness of a surface is often measured in the art in terms of Ra which is defined as the arithmetic mean of the departures of a surface profile from the mean line, defined by the following equation:

$$Ra\frac{\int_0^L y^2(x)\,dx}{L}$$

wherein y(x)=distance of the point on the surface from the mean line, $Y_i$-$Y_{mean}$. The sum of the deviations from the mean equals zero, i.e., $$\int_0^L y(x)\,dx = 0$$

x=coordinate of the point

L=distance on the surface where the roughness was measured.

Ra is expressed as a dimension of length in terms of microinches (μin) in this specification.

The number of peaks on a textured surface can be measured in terms of peak count ("PC"). PC is the number of peaks higher than a specified height per unit length and it is expressed as the inverse of length in units of 1/in in this specification.

Measurements of Ra and PC expressed herein were made with a Taylor/Hobson Surtronic 3+ with the settings Lc=0.01 in; Ra= - - - 1 μin; Ln=0.05 in; Band Width=50 μin. Many other types of measurements can be used to characterize the products of the invention and to adjust the processing conditions as will be apparent to those skilled in the art.

When a textured surface having specified peak characteristics is required, for example, in terms of Ra and PC, one skilled in the art having the benefit of the present disclosure would first prepare a laboratory sample of a textured surface based upon the foregoing description and the following examples. Ra and PC would then be measured on the sample and, based on these measurements, the value of one or more than one of the parameters $i_t$, $i_b$, $t_t$, $t_b$ and $tt_d$ would be adjusted to obtain a textured surface which more closely approximates the desired specifications for Ra and PC. This process is generally repeated a few times until the specifications are met. In most cases, the desired specifications can be attained after three or four laboratory trials of this type and in some cases fine tuning may require an additional one or two laboratory trials. This is a minimal amount of experimentation when you consider the fact that, for example, machine rolls made using the information obtained by such trials could be in production for several years.

EXAMPLES

The following experiments were conducted to illustrate the influence of the parameters $i_t$, $i_b$, $t_t$, $t_b$ and $tt_d$ on the peak characteristics of textured surfaces. For each experiment, an electrodeposition bath having the recipe 240 grams/liter ("g/l") $CrO_3$, 1.35 g/l $H_2SO_4$ and 3.8 g/l $Na_2SiF_6$ was used. Bath temperature was maintained between 47° C. and 52° C. unless otherwise indicated. All of the samples were prepared using the two-step pulse waveform shown in FIG. 1. Deposition was conducted with an EG&G PARC Model 173 Patentiostat/Galvanostat and a Model 175 Universal Programmer. The surface of each substrate was prepared by sandpaper polishing, degreasing in acetone for 10 minutes and etching in 1:1 HCl for 2 minutes. Other preparation methods can be used as known in the art. The distance of the substrate (cathode) from the anode was 5 centimeters ("cm"). The substrate was low carbon steel. Cylindrical shaped electrodes were used having a plating surface of 0.65 cm diameter (surface area 0.32 $cm^2$). The peaks were comprised of nodular structured chromium deposits. Ra was measured in micro inches ("$\mu$in") using a Surtronic 3+ and PC was measured in peaks/inch using a Surtronic 3+ roughness meter. Photomicrographs were taken at 100× magnification using a Leitz Mettalux 3 optical microscope. Digital enhancement of photomicrographs was done using the Edge Detect function (in the 2D Effects menu) of the Corel Photo-Paint 8 program. Scanning electronic photographs were taken with a Scanning Electron Microscope ("SEM") JEOL JSM-840A.

In the tables set forth below under the column entitled "Program Parameters", the first numerical ratio is $i_t/t_t$ wherein $i_t$ is expressed as mA/$cm^2$ and $t_t$ is expressed as milliseconds ("ms"). The second numerical ratio is $i_b/t_b$ expressed in the same units. The third numerical value is $tt_d$ expressed as minutes ("min").

Example 1

Influence of top current density:

$i_t$=1,900–2,000 mA/$cm^2$; Ra=74–120 $\mu$in; PC=217–257/in

When top current density increases, Ra increases; PC slightly decreases. (See Table 1.)

TABLE 1

Influence of top current density

| Sample | Program parameters (mA/$cm^2$; ms; minute) | Descriptions | Ra | PC |
|---|---|---|---|---|
| A | 2500/50<br>50/25<br>80 min. | Dull<br>Uniform<br>Nodular | 120 ± 34 | 217 ± 24 |
| B | 1900/50<br>50/25<br>80 min. | Not uniform<br>Center: bright<br>Edge: nodular | 74 ± 7 | 257 ± 30 |

Example 2

Influence of bottom current density:

$i_b$=5–500 mA/$cm^2$; Ra=125–71; PC=~264.

When bottom current density increases, Ra increases and PC stays essentially the same. (See Table 2.)

TABLE 2

Influence of bottom current density

| Sample | Program parameters (mA/$cm^2$; ms; minute) | Descriptions | Ra | PC |
|---|---|---|---|---|
| C | 2000/50<br>500/25<br>80 min. | Whitish,<br>Uniform,<br>Nodular | 125 ± 9 | 264 ± 12 |
| D | 2000/50<br>100/25<br>80 min. | Whitish,<br>Uniform,<br>Nodular | 97 ± 5 | 264 ± 12 |
| E | 2000/50<br>5/25<br>80 min. | Whitish,<br>Uniform,<br>Nodular | 71 ± 5 | 264 ± 12 |

Example 3

Influence of pulse duration:

$t_t/t_b$=50 ms/20 ms–60000 ms/30000 ms; Ra=64–100 $\mu$in; PC=257–305/in

When pulse durations increase, both Ra and PC decrease. (See Table 3.)

TABLE 3

Influence of pulse duration

| Sample | Program parameters (mA/$cm^2$; ms; minute) | Descriptions | Ra | PC |
|---|---|---|---|---|
| F | 2000/40<br>50/20<br>80 min. | Whitish,<br>Uniform,<br>Nodular | 100 ± 9 | 305 ± 42 |
| G | 2000/400<br>50/200<br>80 min. | Whitish,<br>Uniform,<br>Nodular | 95 ± 7 | 271 ± 13 |
| H | 2000/60000<br>50/30000<br>80 min. | Whitish,<br>Uniform,<br>Nodular | 64 ± 6 | 257 ± 30 |

Example 4

Influence of total deposition time:

$tt_d$=40–120 minutes; Ra=97–112 $\mu$in; PC=190–305/in

When total time increases, Ra slightly increases; PC decreases. (See Table 4 and FIGS. 2-9.)

Example 5

Influence of $t_t/t_b$:

The data illustrated in Table 5 was generated with a total time of top and bottom pulse duration of 75 ms, while the ratio of $t_t/t_b$ was varied. The lower limit for this ratio was found to be 1/1. Below this value, the deposits become uniform and smooth, and the dendritic structure disappears. There is no upper limit because as $t_b$ approaches zero, plating conditions approach DC plating and DC plating can produce dendritic structures when the other conditions of the invention are maintained.

Example 6

Influence of bath temperature:

temp.=46–60° C.; Ra=25–138 $\mu$in; PC=81–487/in

The data in Table 6 illustrates the extreme values of temperature for chrome plating as well as typical samples obtained in the middle range of temperatures. As noted above, suitable temperature ranges vary with the electrochemistry involved as will be apparent to those skilled in the art.

What is claimed is:

1. A method of electrochemically depositing a textured surface comprised of peaks on an electrically conductive substrate comprising the steps of (a) preparing an electrodeposition bath containing metal ions, (b) immersing the substrate in the bath, (c) passing a charge having a first current density greater than about 1,500 mA/$cm^2$ through the bath to the substrate and maintaining said first current density for a first time interval, (d) reducing the charge to a second current density and maintaining said second current density for a second time interval, and (e) repeating steps (c) and (d) for a total deposition time and then removing the substrate from the bath, wherein the ratio of the first time interval to the second time interval is greater than 1, the first current density is greater than the second current density, the second current density is greater than zero and the electrodeposition bath is maintained at a temperature within the operating range of the electrodeposition bath.

2. The method of claim 1 wherein the density, uniformity and size of the peaks is controlled by varying the values of the first current density, the second current density, the first time interval, the second time interval and/or the total deposition time.

3. The method of claim 1 wherein the metal ions are chromium ions and the electrodeposition bath is maintained at a temperature greater than 46° C. and less than 60° C.

4. The method of claim 1 wherein the ratio of the first time interval to the second time interval is from about 2:1 to about 6.5:1.

5. A method for preparing an electrochemically deposited textured surface having specific peak characteristics comprising the steps of (a) preparing an electrodeposition bath containing metal ions, (b) immersing an electrically conductive substrate in the bath, (c) passing a charge having a first current density greater than about 1,500 $mA/cm^2$ through the bath to the substrate and maintaining said first current density for a first time interval, (d) reducing the charge to a second current density and maintaining said second current density for a second time interval, and (e) repeating steps (c) and (d) for a total deposition time to make an electrochemically deposited textured surface on the substrate, (f) removing the substrate from the bath and measuring the peak characteristics of the electrochemically deposited textured surface thereon, (g) changing the value of at least one of the first current density, first time interval, second current density, second time interval and total deposition time to cause the peak characteristics to change so that they more closely approximate the specific peak characteristics, (h) repeating steps (a)–(g) until the electrochemically deposited textured surface having specific peak characteristics is prepared, wherein the ratio of the first time interval to the second time interval is greater than 1, the first current density is greater than the second current density, the second current density is greater than zero and the electrodeposition bath is maintained at a temperature within the operating range of the electrodeposition bath.

6. The method of claim 5 wherein the metal ions are chromium ions and the electrodeposition bath is maintained at a temperature greater than 46° C. and less than 60° C.

7. The method of claim 5 wherein the ratio of the first time interval to the second time interval is from about 2:1 to about 6.5:1.

* * * * *